United States Patent [19]

Hogenson

[11] Patent Number: 4,643,783

[45] Date of Patent: Feb. 17, 1987

[54] AUTOMATIC TAPE SPLICING MACHINE

[75] Inventor: Raymond A. Hogenson, Shoreview, Minn.

[73] Assignee: Minnesota Mining and Manufacturing Company, Saint Paul, Minn.

[21] Appl. No.: 724,618

[22] Filed: Apr. 18, 1985

[51] Int. Cl.[4] ..... B65H 19/10

[52] U.S. Cl. ..... 156/64; 156/159; 156/304.3; 156/350; 156/353; 156/504; 156/506; 242/58.2; 242/58.6

[58] Field of Search ..... 156/159, 304.3, 505, 156/506, 504, 64, 157, 350, 353; 242/55.3, 58.1, 58.2, 58.4, 58.6

[56] References Cited

U.S. PATENT DOCUMENTS

| | | | |
|---|---|---|---|
| 3,472,724 | 10/1969 | Casey | 156/521 |
| 4,204,898 | 5/1980 | King | 156/159 |
| 4,392,912 | 7/1983 | Horsley | 156/504 |
| 4,501,630 | 2/1985 | Kiuchi | 156/505 |
| 4,543,149 | 9/1985 | Abe et al. | 242/58.2 |

*Primary Examiner*—Michael Wityshyn

*Attorney, Agent, or Firm*—Donald M. Sell; James A. Smith; William L. Huebsch

[57] ABSTRACT

A machine and method for splicing a new length of linered tape to a length of linered tape being pulled from the machine without interrupting the movement of the tape out of the machine. The tape is pulled along a supply path aligned with an outlet path, a clamp is activated to stop tape movement at an inlet to the outlet path while a path length changing mechanism is activated to shorten the outlet path at the same rate that tape is being pulled from the machine, the length of tape being pulled from the machine is cut between the outlet path and the supply path, the end of another supply path carrying the new supply length of tape is aligned with the outlet path, splicing means splice together liners on the tape ends at the aligned end and inlet, the clamp is released after such splicing, and the outlet path is returned to its normal length.

6 Claims, 2 Drawing Figures

AUTOMATIC TAPE SPLICING MACHINE

TECHNICAL FIELD

This invention relates to devices for forming end to end splices between supply lengths of tape.

BACKGROUND ART

Tape comprising a backing having a layer of pressure sensitive adhesive on both sides (e.g. Acrylic foam tape available from Minnesota Mining and Manufacturing Company, St. Paul, Minn.) is finding wide acceptance for adhering body side moldings to automobiles. Such tape is supplied to the automaker in rolls and has a liner over one coating of pressure sensitive adhesive to afford unwinding of the tape. The automaker continuously extrudes the side molding, cools it as by allowing it to pass through a water bath, presses the non-liner covered adhesive coated surface of the tape against a surface of the molding, and subsequently rolls the extrusion into a supply coil or cuts it to length for use on autos. The moving extrusion pulls the tape from the supply roll which typically is supported on a rotatable hub.

Typically when the end of the tape on any one roll is reached, an operator manually adheres the beginning of the tape on another roll in end to end relationship with that end on the extrusion, whereupon the tape is pulled from the new roll. Such manual splicing requires frequent attention of the operator and may require the operator to wait at the roll while an end portion of the tape unwinds before the new roll can be started. Also, if the operator is not present when that end is reached, many yards of extrusion may move past the place of tape application without being taped, which can result in costly manual taping or scraping of such untaped extrusion.

DISCLOSURE OF THE INVENTION

The present invention provides a machine and method for automatically splicing a new length of tape to a length of tape being pulled from the machine without interrupting the movement of tape out of the machine, which machine and method are adapted for use with pressure sensitive adhesive coated tape of the type described above having a liner along one surface, and thus greatly extend the time periods within which an operator needs to load the machine with new rolls of tape, and allows the operator to load new rolls on the machine at any time while the machine is already supplying tape from a roll.

The automatic tape splicing machine according to the present invention comprises outlet path means defining an outlet path guiding tape for movement from an inlet to an outlet of the outlet path, which outlet path means includes path length changing means for changing the length of the outlet path from a normal length to shorter lengths, and clamping means along the outlet path between the inlet and the path length changing means for clamping a piece of the tape at a fixed position along the outlet path. Tape supply means comprising tape roll support means are provided for rotatably supporting rolls of the tape, as are supply path means defining a separate tape supply path for guiding tape from each of the rolls to an end of the supply path. Moving means mount the tape supply means for movement to align any one of the supply paths with the tape outlet path with the end and inlet of those paths closely adjacent, and splicing means are provided for applying a length of splicing tape to splice together the liners on end portions of tape adjacent the inlet of the outlet path and the end of the supply path aligned with the outlet path, together with cutting means for cutting a length of tape extending between the outlet path and the aligned supply path. Control means are provided (1) for sensing an end of a tape being pulled along the supply path aligned with the outlet path, and, in response to sensing the tape end, (2) for activating the clamping means to stop tape movement at the inlet of the tape outlet path; (3) for activating the path length changing means to shorten the tape outlet path at a rate such that tape being pulled from the machine will be provided by the decrease in length in the tape outlet path; (4) for activating the cutting means to cut the length of tape being pulled from the machine between the inlet of the tape outlet path and the end of the aligned tape supply path; (5) for activating the moving means after the activation of the cutting means to align another of the supply paths with the outlet path; (6) for activating the splicing means to splice together the liners on the tape end portions adjacent the inlet of the supply path and the end of the aligned supply path; (7) for releasing the clamping means after the operation of the splicing means; and (8) for returning the path length changing means to again provide the normal outlet path length.

Preferably the path length changing means in the machine comprises a first set of rollers rotatably mounted at and defining fixed locations along the outlet path, a second set of rollers, and movable means rotatably mounting the second set of rollers for movement to change the spacing between the first and second sets of rollers. The tape along the tape outlet path alternately extends around one roller of the first set of rollers and one roller of the second set of rollers so that movement of the movable means to decrease the spacing between the first and second sets of rollers will decrease the length of the outlet path, and movement of the movable means to increase the spacing between the first and second sets of rollers will increase the length of the outlet path.

Also, the splicing means preferably comprises means for advancing a supply length of splicing tape along a splicing tape path, means for severing the advanced length of splicing tape from the supply length, and means for adhering the severed length of splicing tape to the liners on portions of tape adjacent the inlet of the outlet path and the end of the aligned supply path.

As illustrated, the supply paths defined by the supply path means are linear and parallel with the ends of the supply paths being aligned in a direction normal to the supply paths, the moving means affords transverse movement of the supply paths to align any one of the supply paths with the outlet path, and the cutting means comprises a knife, and means mounting the knife for movement in a path along the aligned ends of the supply paths.

BRIEF DESCRIPTION OF DRAWING

The present invention will be further described with reference to the accompanying drawing wherein.

DETAILED DESCRIPTION

Figure 1:
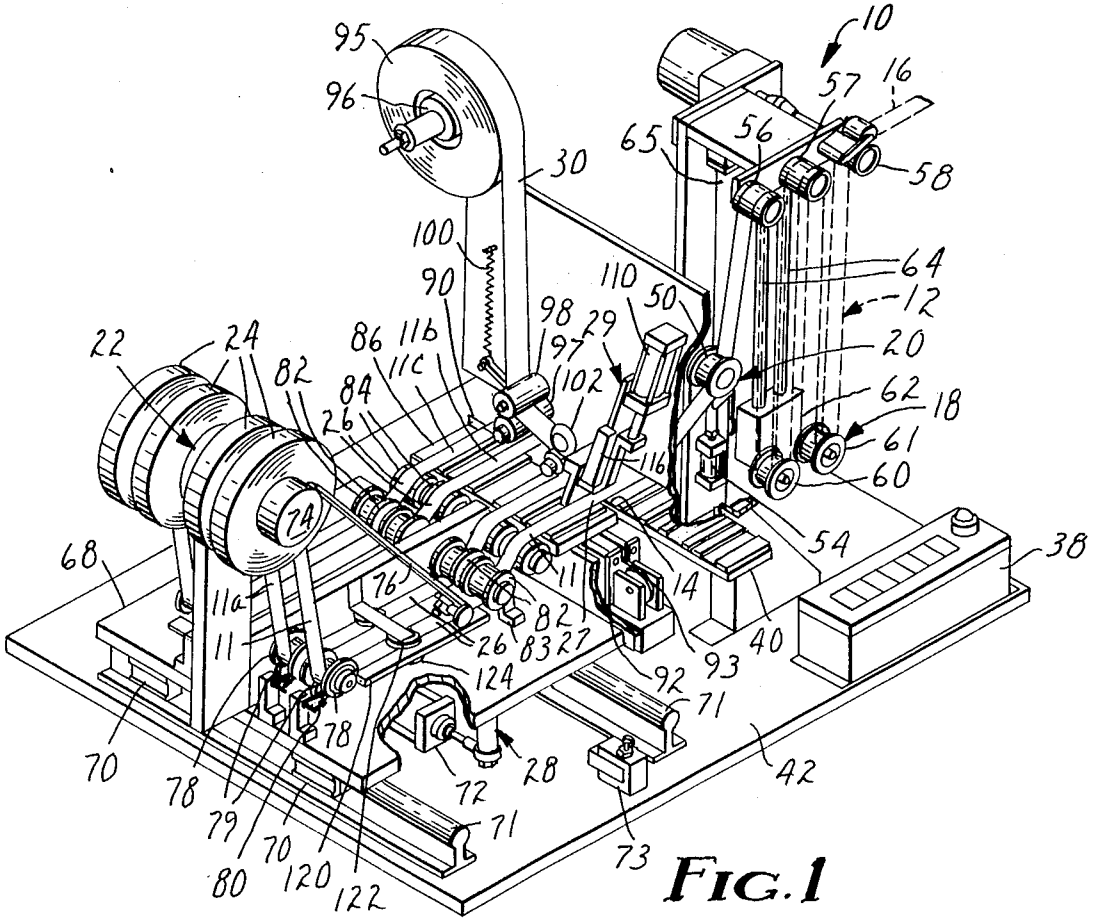
FIG. 1 shows a perspective view of an automatic tape splicing machine according to the present invention having parts broken away to show detail.
Figure 2:
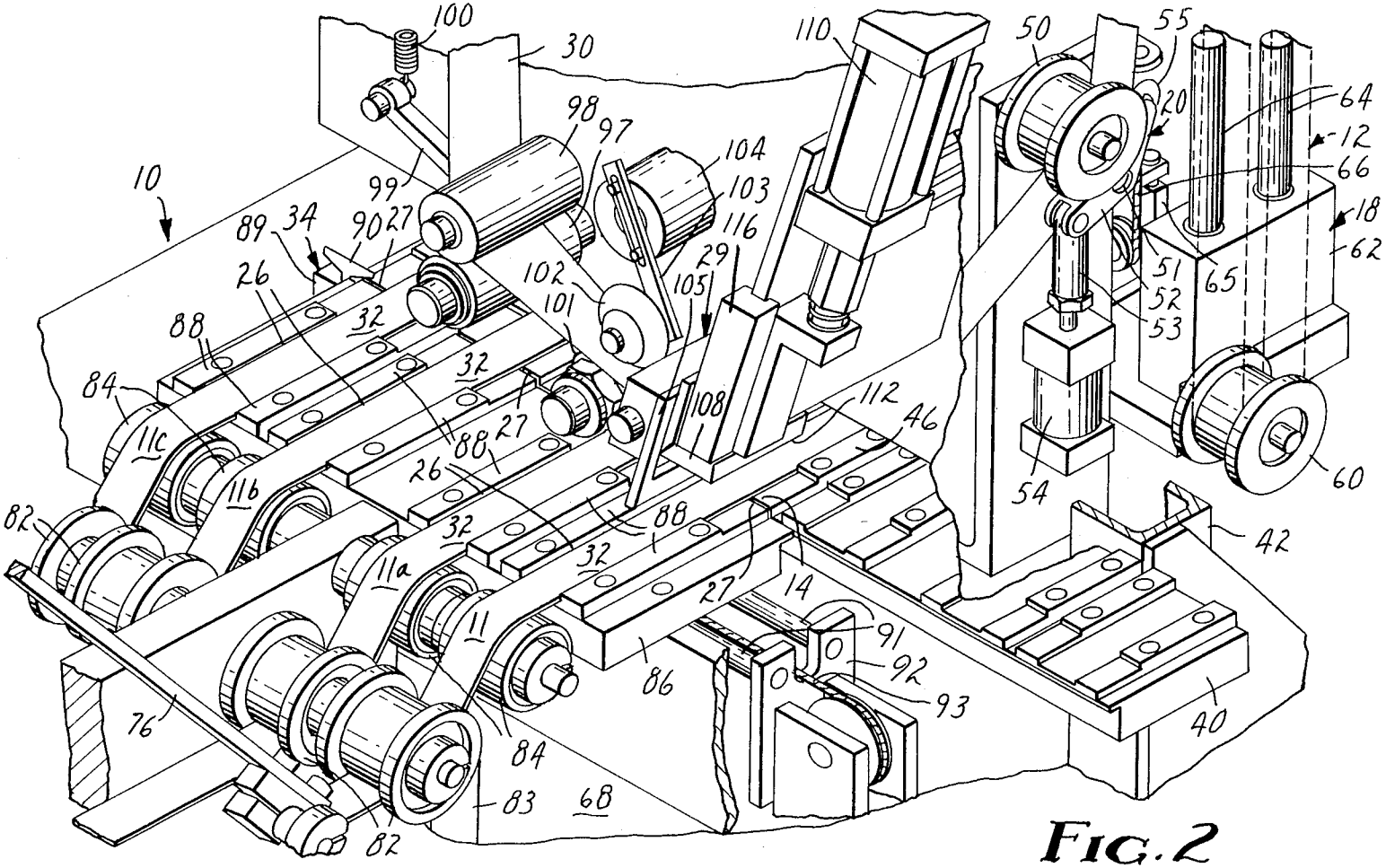
FIG. 2 is a fragmentary view showing an enlarged central portion of the machine shown in FIG. 1.

Referring now to the drawing, there is shown an automatic tape splicing machine according to the present invention generally designated by the reference numeral 10, which machine 10 can splice a new supply length of tape 11*a*, 11*b* or 11*c* to a length of tape 11 being pulled from the machine without interrupting the movement of the tape 11 out of the machine 10, and is adapted for use with pressure sensitive adhesive coated tape having a liner 32 along one surface.

Briefly, the machine 10 comprises outlet path means defining an outlet path 12 guiding tape 11 (shown in phantom outline) for movement from an inlet 14 to an outlet 16 of the outlet path 12, which outlet path means includes path length changing means 18 for changing the length of the outlet path 12 from a normal length to shorter lengths, and clamping means 20 along the outlet path 12 between the inlet 14 and the path length changing means 18 for clamping a piece of the tape 11 at a fixed position along the outlet path 12. Tape supply means are provided comprising tape roll support means 22 for rotatably supporting supply rolls 24 of the tape 11, and supply path means defining a separate supply path 26 for guiding tape from each of the supply rolls 24 to an end 27 of the supply path 26, as are moving means 28 mounting the tape supply means for movement to align any one of the supply paths 26 with the outlet path 12, splicing means 29 for applying a length of splicing tape 30 to splice together the liners 32 on portions of tape 11 adjacent the inlet 14 of the outlet path 12 and the end 27 of the aligned supply path 26, and cutting means 34 for cutting a length of tape 11 extending between the outlet path 12 and the aligned supply path 26.

Control means, comprising a control box 38, are provided for sensing an end of tape 11 being pulled along the supply path 26 aligned with the outlet path 12, and, in response to sensing the tape end, (2) for activating the clamping means 20 to stop tape movement at the inlet 14 of the outlet path 12; (3) for activating the path length changing means 18 to shorten the outlet path 12 at a rate such that tape being pulled from the machine 10 will be provided by the decrease in length in the outlet path 12; (4) for activating the cutting means 34 to cut the length of tape being pulled from the machine 10 between the inlet 14 of the outlet path 12 and the end 27 of the aligned supply path 26; (5) for activating the moving means 28 after the activation of the cutting means 34 to align the end of another of the supply paths 26 with the inlet 14 of the outlet path 16; (6) for activating the splicing means 29 to splice together the liners 32 on the tape end portions on the tape supply path and the newly aligned supply path 26; (7) for releasing the clamping means 20 after the operation of the splicing means 29; and (8) for returning the path length changing means 18 to again provide the normal tape outlet path 12 length.

The outlet path means defining the outlet path 12 includes a guide block 40 fixed on a frame 42 for the machine 10, which guide block 40 has a top horizontal guide surface covered with a polymeric material to which pressure sensitive adhesive on the tape surface will not easily adhere (e.g., polysiloxane rubber), side rails 46 to guide the edges of the tape 11 along the guide surface, and a vertical edge that defines the inlet 14 to the outlet path 12. Also included are a pair of guide rollers (not shown) rotatably mounted on the frame 42 at the edge of the guide block 40 opposite the inlet 14 that move the tape 11 through a sharp reverse-S-shaped path portion which is intended to cause the butt ends of the spliced tapes to touch each other so that the pressure sensitive adhesive adjacent those butt ends adhere them together; and a support roller 50 fixed on a vertically projecting portion of the frame 42 which, together with an arm 52 pivotably mounted on a pin 51 at about its center on the frame 42, a piston assembly 54 that has its plunger 53 pivotably attached to the arm 52, and a roller 55 having a periphery of polysiloxane rubber and a fixed projecting axle slidably received in horizontal slots in the end of the arm 52 opposite the plunger 53, provide the clamping means. The piston assembly 54 can be operated to pivot the arm 52 between a release position with the roller 55 spaced from the tape 11 on the periphery of the support roller 50, and an engaged position at which the roller 55 is pressed between the tape 11 along the support roller 50 and a surface of the arm 52 to provide the clamping means. This arrangement both provides efficient clamping of the tape 11 by immobilization of the roller 55 when the arm 52 is in its clamping position and allows the roller 55 to rotate to help release any adhesive engagement between the roller 55 and the tape 11 after the arm 52 moves to its release position. The outlet path is further defined by five rollers included in the path length changing means, including a first set of three rollers 56, 57 and 58 rotatably mounted in fixed spaced locations along the outlet path 12 on an extension of the frame 42, and a second set of two rollers 60 and 61 rotatably mounted in spaced location on a block 62 slidably mounted on a pair of vertically extending parallel rods 64 for movement to change the spacing between the first and second sets of rollers. The tape 11 along the outlet path 12 alternately extends around one roller of the first set of rollers and one roller of the second set of rollers so that movement of the block 62 to decrease the spacing between the first and second sets of rollers will decrease the length of the outlet path 16 and movement of the block 62 to increase the spacing between the first and second sets of rollers will increase the length of the outlet path 12. Upon activation of the clamping means by the control means to clamp the tape 11 to the support roller 50 the block 62 will move against the bias provided by its weight from a fully extended position shown in FIG. 1, toward a retracted position (not shown) more closely adjacent the first set of rollers at a rate that will decrease the length of the outlet path 12 at the same rate tape is being pulled from the machine 10, thereby providing an uninterrupted supply of tape 11 from the tape along the outlet path 12 while a new supply of tape is spliced to the end of the tape 11 along the outlet path 12. A piston assembly 65 of the type including a cable 66 having its ends attached to opposite ends of its piston and extending around and externally between pulleys at the ends of the assembly 65 (e.g., the piston assembly commercially designated Cable Cylinder available from Tol-O-Matic, Inc., Minneapolis, Minn.) has its cable 66 extending through a tab projecting from the block 62 and the cable 66 is fitted with a stop member such that the block 62 can move toward the first set of rollers to shorten the outlet path without moving the cable 66, but the piston assembly 65 can be activated by the control means to engage and move the block 62 to its fully extended position which the control means will do after a splice is made and the clamping means 20 is released.

The moving means 28 mounting the tape supply means for movement to align any one of the supply paths 26 with the outlet path 12 comprises a carriage 68 comprising a plate having four bearing blocks 70 (only two of which are shown) fixed to its bottom surface and slidably mounted on two parallel rails 71 fixed to the frame 42 for movement to align any one of the supply paths 26 with the outlet path 12. A locating assembly 72 is provided that comprises two piston assemblies with pistons of different lengths with the ends of their housings opposite their exposed piston ends bolted together. One piston of the assembly 72 is attached to the carriage 68 and the other piston is attached to the frame 42. Operation of the piston assembly 72 is controlled by the control means to retract or extend both pistons, or extend either one of the pistons and retract the other to move the carriage 68 between four positions with a different one of the supply paths 26 being aligned with the outlet path 12 at each of the four positions.

The tape supply means comprises fixed hubs 74 projecting horizontally in opposite directions from an upwardly projecting portion of the carriage 68, around which hubs 74 the supply rolls of tape 24 are rotatably supported, with proper spacing for the rolls of tape 24 along the hubs 74 being maintained by guide rods 76 having ends resting on the hubs 74 between the rolls 24 and being pivotably mounted on the carriage 68 at their ends opposite the hubs 74 to afford pivotal movement of the guide rods 76 away from the hubs 74 so that empty cores may be removed and new rolls of tape 24 may be placed on the hubs 74.

Also included in the supply path means are four similar sets of guide rollers rotatably mounted on the carriage 68 with each set partially defining one of the four tape supply paths 26, and including a first guide roller 78 against which the linered surface of the tape 11 is biased by a pressure roller assembly 79 including a polysiloxane rubber coated pressure roller rotatably mounted on an arm pivotally on the frame 42, which arm is biased toward the guide roller 78 by a spring 80, a second guide roller 82 spaced from the first guide roller 78 to provide a horizontal tape path portion therebetween and against which the linered surface of the tape 11 is biased by a pressure roller assembly 83 similar to the assembly 79, and a third polysiloxane rubber covered guide roller 84 that contacts the adhesive coated surface of the tape. Also helping to define each of the supply paths 24 is a platen 86 having a horizontal guide surface covered with a polysiloxane rubber that is contacted by the pressure sensitive adhesive on the tape 11 and side rails 88 that define part of each supply path 26 leading to the end 27 of the supply path 26 that is defined by the edge of the platen 86 opposite the rollers 78, 82 and 84. Thus, the supply paths 26 defined by the supply path means are linear and parallel with the ends 27 of the supply paths 26 being aligned in a direction normal to the supply paths 26 and the moving means affords transverse movement of the supply paths 26 to align any one of the supply paths 26 with the outlet path 12 with the ends of the aligned supply path 26 closely adjacent the inlet 14 of the outlet path 12.

The cutting means comprises a double edged knife 90 mounted on a carriage 89, means in the form of two parallel rods 91 mounting the carriage so that its movement will move the knife 90 in a path along the aligned ends 27 of the supply paths 26 and the inlet 14 to the outlet path 12, and a cylinder assembly 92 similar to the cylinder assembly 66 adapted to be controlled by the control means having a cable 93 coupled to the carriage 89 that can move the knife 90 in both directions along its path to cut tape 11 extending between the outlet path 12 and the supply path 26 aligned with it.

As illustrated, the machine 10 also includes means on the frame 42 for holding an end of a length of tape 11 loaded along a supply path 26 that is not aligned with the outlet path 12, and the knife 90 is adapted to move along the ends 27 of all of the supply paths 26 upon activation of the cutting means so that it will cut tape 11 extending past the ends 27 of each of the supply paths 26. This allows a user to position a new length of tape 11 loaded into the machine 10 with its end projecting past the end 27 of a supply path 26, whereupon the knife 90 will precisely cut it at the end 27 of that supply path 26 the next time the cutting means 34 is activated by the control means.

The splicing means 29 is an adaptation of the structure described in U.S. Pat. No. 3,472,724, incorporated herein by reference, which includes means for advancing a supply length of splicing tape 30 along a splicing tape path, means for severing the advanced length of splicing tape 30 from the supply length, and means for adhering the severed length of splicing tape to the liners 32 on portions of tape 11 adjacent the inlet 14 of the outlet path 12 and the end 27 of the aligned supply path 26. The splicing tape 30 described herein comprises a laminate of polyester and polyethylene (e.g., Heat Bondable Film sold by the Automotive Specialties Division of Minnesota Mining and Manufacturing Company, St. Paul, Minn.), with the polyethylene being heat softenable so that it can be heat sealed to the liner which also comprises heat softenable polyethylene. Pressure sensitive adhesive coated splicing tapes would also be usable.

The supply length of splicing tape 30 is supported in a roll 95 around a rotatable but frictionally retarded hub 96 mounted on a projection on the frame 42, and has an end extending between a roller 97 rotatably mounted on the frame 42 and a roller 98 rotatably mounted on an arm 99 pivotably mounted on the frame 42 and biased by a spring 100 to bias the splicing tape 30 against the roller 98, and then between a roller 101 rotatably mounted on the frame 42 and having a V-shaped groove around its periphery, and a roller 102 having a V-shaped periphery rotatably mounted on an arm 103 and biased by a rotary spring assembly 104 to press the splicing tape 94 into the groove around the roller 101. Interaction between the V-shaped and V-grooved rollers 102 and 101 provide a V-shaped cross section for the end of the splicing tape 94 which causes it to extend in a straight line beyond the rollers 101 and 102 through a window in a plate 105 that provides a portion of the means for severing. The rollers 97 and 101 are driven for a predetermined time by the drive means to project a predetermined length of the splicing tape 94 through the window in the plate 105, and a slidable plate 108 attached to the plunger of cylinder assembly 110 may then be activated by the control means to sever the projecting length of splicing tape 94 by interaction between the adjacent edges of the plates 105 and 108. The slidable plate 108 has a bottom surface 112 disposed to press the severed lengths of splicing tape 94 against the liners 32 on the portions of the tapes 11 adjacent the inlet 14 of the outlet path 12 and the end 27 of the supply path 26 aligned with it, and an electric heater 116 is mounted on the opposite side of the plate 105 to heat the plate 105 so that it will fuse the severed splicing tape 30 to those portions of the liners 32.

The means for sensing the end of the tape along the supply path 26 aligned with the outlet path 12 comprises a platen 120 of a polymeric material such as Teflon TM closely adjacent the portion of each supply path 26 between the first and second guide rollers 78 and 82, which platen 120 has a through opening, a reflector 122 mounted above the through opening in the platen 120 on the side of each supply path 26 opposite the platen 120 and a light source and sensor unit 124 mounted on the frame 42 below the opening in the platen 120 and the reflector 122 along the supply path 26 aligned with the outlet path 12. The carriage 68 also has an opening so that light from the light source and sensor 124 will be directed through the opening in the carriage 68 and platen 120 to shine on tape 11 along the supply path 26 which will not reflect sufficient light to activate the sensor 124. When, however, the end of the tape 11 passes from over those openings, the light will strike the reflector 122 and will be reflected back to the sensor 124 with sufficient intensity to activate it, thereby signalling the control means to start the cycle to splice a new supply length of tape 11*a*, 11*b* or 11*c* to the lengths of tape 11 along the outlet path 12.

The present invention has now been described with respect to one embodiment of the present invention. It will be apparent to those skilled in the art that the functions described in the present invention can be performed by structures differing significantly from the structures described herein. Thus, the scope of the invention described herein shall not be limited by the structure described in this specification, but only by structure described by the language of the claims and their equivalents.

I claim:

1. A machine for splicing a new length of tape to a length of tape being pulled from the machine without interrupting the movement of tape out of the machine, which machine is adapted for use with pressure sensitive adhesive coated tape having a liner along one surface, said machine comprising:

outlet path means defining an outlet path guiding tape for movement from an inlet to an outlet of said outlet path, said outlet path means including path length changing means for changing the length of said outlet path from a normal length to shorter lengths, and clamping means along said outlet path between said inlet and said path length changing means for clamping a piece of the tape at a fixed position along said outlet path;

tape supply means comprising tape roll support means for rotatably supporting supply rolls of said tape, and supply path means defining a separate supply path for guiding tape from each of said supply rolls to an end of said supply path;

moving means mounting said tape supply means for movement to align any one of said supply paths with said outlet path;

splicing means for applying a length of splicing tape to splice together the liners on end portions of tape adjacent the inlet of said outlet path and the end of the supply path aligned with said outlet path;

cutting means for cutting a length of tape extending between said outlet path and the end of the supply path aligned with the outlet path; and control means (1) for sensing an end of tape being pulled along the supply path aligned with said tape outlet path, and, in response to sensing said tape end, (2) for activating said clamping means to stop tape movement at the inlet of said tape outlet path; (3) for activating said path length changing means to shorten said tape outlet path at a rate such that tape being pulled from said machine will be provided by the decrease in length in said tape outlet path; (4) for activating said cutting means to cut the length of tape being pulled from the machine between the inlet of the outlet path and the end of the aligned supply path; (5) for activating said moving means after the activation of said cutting means to align another of said supply paths with said outlet path; (6) for activating said splicing means to splice together the liners on the tape end portions adjacent the supply path inlet and the end of the newly aligned supply path; (7) for releasing said clamping means after the operation of said splicing means and for returning said path length changing means to again provide said normal outlet path length.

2. A machine according to claim 1 wherein said path length changing means comprises a first pair of rollers rotatably mounted at and defining fixed locations along said outlet path, a second pair of rollers, and movable means rotatably mounting said second pair of rollers for movement to change the spacing between said first and second pairs of rollers, said tape along said outlet path alternately extending around one roller of said first pair of rollers and one roller of said second pair of rollers so that movement of said movable means to decrease the spacing between said first and second pairs of rollers will decrease the length of said outlet path, and movement of said movable means to increase the spacing between said first and second pairs of rollers will increase the length of said outlet path.

3. A machine according to claim 1 wherein said splicing means comprises means for advancing a supply length of splicing tape along a splicing tape path, means for severing said advanced length of splicing tape from said supply length of splicing tape; and means for adhering said severed length of splicing tape to the liners on portions of tape adjacent said inlet and the end of the supply path aligned with the outlet path.

4. A machine according to claim 1 wherein said supply paths defined by said supply path means are linear and parallel with the ends of said supply paths being aligned in a direction normal to said supply paths, and said moving means affords transverse movement of said supply paths to align one of said supply paths with said outlet path.

5. A machine according to claim 4 wherein said cutting means comprises a knife, and means mounting the knife for movement in a path along the aligned ends of said supply paths.

6. A method for splicing a new length of tape to a length of tape being pulled from a machine without interrupting the movement of tape out of the machine, which method is adapted for use on pressure sensitive adhesive coated tape having a liner along one surface, said method comprising the steps of:

providing outlet path means defining an outlet path guiding tape for movement from an inlet to an outlet of the outlet path, the outlet path means including path length changing means for changing the length of the outlet path from a normal length to shorter lengths, and clamping means along the outlet path between the inlet and the path length changing means for clamping a piece of the tape at a fixed position along the outlet path; tape supply means comprising tape roll support means for rotatably supporting supply rolls of the tape, and supply path means defining a separate supply path for guiding tape from each of the supply rolls to an end of the supply path; moving means mounting the tape supply means for movement to align any one of the supply paths with the outlet path; splicing means for applying a length of splicing tape to splice together the liners on end portions of tape adjacent the inlet of the outlet path and the end of the supply path aligned with the outlet path; cutting means for cutting a length of tape extending between the outlet path and the end of the supply path aligned with the outlet path;

sensing an end of tape being pulled along the supply path aligned with the outlet path;

in response to sensing the end of tape, activating the clamping means to stop tape movement at the inlet of the outlet path;

activating the path length changing means to shorten the outlet path at a rate such that tape being pulled from the machine will be provided by a decrease in length in the outlet path;

activating the cutting means to cut the length of tape being pulled from the machine between the the tape outlet path and the aligned supply path;

activating the moving means after the activation of the cutting means to align another of the supply paths with the outlet path;

activating the splicing means to splice together the liners on the tape end portions adjacent the inlet of the supply path and the end of the newly aligned supply path;

releasing the clamping means after the operation of the splicing means and returning the path length changing means to again provide the normal outlet path length.

* * * * *